US008707503B2

(12) United States Patent
Saccoccio et al.

(10) Patent No.: US 8,707,503 B2
(45) **Date of Patent: *Apr. 29, 2014**

(54) SWIMMING POOL BRUSH

(71) Applicant: Asia Connection LLC, New York, NY (US)

(72) Inventors: Mitch Saccoccio, Clarksville, VA (US); Jonathan Bonelli, New York, NY (US)

(73) Assignee: Asia Connection LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/939,621

(22) Filed: Jul. 11, 2013

(65) Prior Publication Data

US 2013/0298343 A1 Nov. 14, 2013

Related U.S. Application Data

(63) Continuation-in-part of application No. 13/864,775, filed on Apr. 17, 2013.

(60) Provisional application No. 61/639,253, filed on Apr. 27, 2012.

(51) Int. Cl.
*E04H 4/16* (2006.01)

(52) U.S. Cl.
USPC ..... 15/160; 15/1.7

(58) Field of Classification Search
USPC ..... 15/160, 1.7
See application file for complete search history.

(56) References Cited

U.S. PATENT DOCUMENTS

| | | | | |
|---|---|---|---|---|
| 2,083,134 | A | 6/1937 | Wood | |
| 3,273,187 | A * | 9/1966 | Williams | 15/1.7 |
| 3,296,643 | A | 1/1967 | Fortune | |
| 4,176,419 | A | 12/1979 | MacDonald | |
| D257,521 | S | 11/1980 | Piero | |
| 4,479,277 | A | 10/1984 | Gilman et al. | |
| 4,637,087 | A | 1/1987 | Feinberg | |
| 4,703,535 | A | 11/1987 | Nehls | |
| 4,733,427 | A | 3/1988 | Conrad | |
| 4,783,868 | A | 11/1988 | O'Callaghan | |
| D351,948 | S | 11/1994 | Getchell | |
| 5,487,397 | A | 1/1996 | Bean | |
| 6,148,466 | A * | 11/2000 | Smitelli et al. | 15/160 |
| 8,024,833 | B2 | 9/2011 | Fuller et al. | |
| 2007/0277338 | A1 * | 12/2007 | Takeuchi et al. | 15/167.1 |

* cited by examiner

*Primary Examiner* — Monica Carter
*Assistant Examiner* — Stephanie Berry
(74) *Attorney, Agent, or Firm* — Dilworth & Barrese, LLP

(57) ABSTRACT

A pool brush includes a handle receiver; and a brush head attached to the handle receiver, the brush head having a body and a plurality of bristles extending from said body. The body includes a cylindrical portion having rounded top, bottom, front and rear sides, and opposite end portions, and the plurality of bristles includes bristles radially extending 360 degrees around the cylindrical portion of the body and from the end portions. In an embodiment, the plurality of bristles includes a plurality of bundles of relatively longer bristles and a plurality of bundles of relatively shorter bristles, wherein the bundles of relatively longer bristles are in arrays in an alternating arrangement with arrays of the bundles of shorter bristles. In an embodiment the body has angled portions.

23 Claims, 5 Drawing Sheets

SWIMMING POOL BRUSH

CROSS REFERENCE TO RELATED APPLICATIONS

The present application is a continuation in part of U.S. application Ser. No. 13/864,775 filed Apr. 17, 2013, which claims priority to U.S. Provisional application No. 61/639,253 filed Apr. 27, 2012, which is herein incorporated by reference.

BACKGROUND

1. Field of the Invention

This invention relates to swimming pool cleaning devices, and in particular to a cylindrical swimming pool brush head having rounded ends with bristles perpendicularly mounted along the rounded sides so that hard to reach narrow angled areas such as corners, stairs, and seat areas can be cleaned.

2. Background of the Art

Swimming pool brushes have been around for many years. Most traditional brushes have an elongated handle connected to a brush head. See for example U.S. Pat. No. D. 351,948 to Getchell; U.S. Pat. No. 3,296,643 to Fortune; U.S. Pat. No. 4,637,087 to Feinberg; U.S. Pat. No. 4,703,535 to Nehls; U.S. Pat. No. 4,733,427 to Conrad; U.S. Pat. No. 4,783,868 to O'Callaghan; and U.S. Pat. No. 5,487,397 to Bean. However, these references are limited to having bristles oriented generally downward, and are not capable of adequately cleaning all corners where walls and floors come together, areas where different planar walls intersect, edge areas where walls meet floors, and around stairs, seats and the like.

U.S. Pat. No. Des. 257,521 to Piero; and U.S. Pat. No. 4,176,419 to MacDonald each describe other pool brushes where the bristles are only oriented about part of the perimeter edges of the brush head, and are also not capable of adequately cleaning all corners where walls and floors come together, areas where different planar walls intersect, edge areas where walls meet floors, around stairs, seats and the like.

U.S. Pat. No. 2,083,134 to Wood shows a complex brush for "cleaning vats" having separately positioned bristle heads attached to two parallel brush heads, and also would not appear to be capable of adequately cleaning all corners where walls and floors come together, areas where different planar walls intersect, edge areas where walls meet floors, around stairs, seats and the like.

U.S. Pat. No. 3,273,187 to Williams shows a triangular "vacuum cleaner head" of bristles that would be difficult to maneuver and use for adequately cleaning all corners where walls and floors come together, areas where different planar walls intersect, edge areas where walls meet floors, around stairs, seats and the like.

U.S. Pat. No. 4,479,277 to Gilman et al. describes a scrub pad brush with downwardly oriented bristles and one side edge having rounded edge bristles. However, Gilman requires a handle parallel to a small rectangular pad brush head with only rounded bristles on one side edge and does not describe any application for cleaning pools and can not be used for adequately cleaning all corners where walls and floors come together, areas where different planar walls intersect, edge areas where walls meet floors, around stairs, seats and the like.

U.S. Pat. No. 6,148,466 to Smitelli, III et al. discloses a pool brush having a cylindrical body with semi-spherical rounded ends. The bristles, when the head is seen in cross section, extend about 280 degrees around the body with the body having a flat portion in top.

SUMMARY

A pool brush is provided herein which comprises (a) a handle receiver; and (b) a brush head attached to the handle receiver, the brush head having a body and a plurality of bristles extending from said body, wherein said body includes a cylindrical portion having rounded top, bottom, front and rear sides, and opposite end portions, and said plurality of bristles includes bristles radially extending 360 degrees around the cylindrical portion of the body and from the end portions. In an embodiment, the plurality of bristles includes a plurality of bundles of relatively longer bristles and a plurality of bundles of relatively shorter bristles, wherein at least some of the bundles of relatively longer bristles are in arrays in an alternating arrangement with arrays of the bundles of shorter bristles. In another embodiment the body has angled portions.

The present invention advantageously provides a simple, efficient pool brush for easily cleaning all corners where walls and floors come together, areas where different planar walls intersect, edge areas where walls meet floors, around stairs, seats and the like, while simultaneously being able to clean all other surface areas of a pool. Furthermore, the pool brush herein can clean the underside of pool steps without turning the brush over, which is a significant advantage.

BRIEF DESCRIPTION OF THE DRAWINGS

Various embodiments are described below with reference to the drawings wherein.

DETAILED DESCRIPTION OF PREFERRED EMBODIMENT(S)

It will be understood that any numerical range recited herein is intended to include all sub-ranges within that range.

It will be further understood that any compound, material or substance which is expressly or implicitly disclosed in the specification and/or recited in a claim as belonging to a group of structurally, compositionally and/or functionally related compounds, materials or substances includes individual representatives of the group and all combinations thereof.

A preferred embodiment of the pool brush includes a handle receiver configured to receive an elongated handle, and a brush head having a cylindrical body with rounded front, bottom and rear sides. The cylindrical body preferably has opposite semi-spherical rounded ends and a mid-portion perpendicularly connected to the elongated handle, where the handle is longer than the brush head.

The bristles are perpendicularly mounted to the front, bottom and rear rounded surface sides, as well as to the semi-spherical rounded ends of the brush head. A cross-sectional view of the cylindrical brush head shows the bristles extending outward in a 360 degree range. Mounting the bristles on all the rounded surfaces of the brush head allows the pool brush to be able to clean all interior and exterior pool surface areas as well as where walls intersect, walls meet floors, around stairs, and around pool seats. The bristles on the top surface of the brush head advantageously allow the brush to clean the underside of the pool steps without turning the brush over. The bristles can be made of natural or synthetic fibers, particularly nylon, polypropylene, polybutylene terephthalate and the like, and, as described below, can be of different lengths and hardness.

Figure 1:
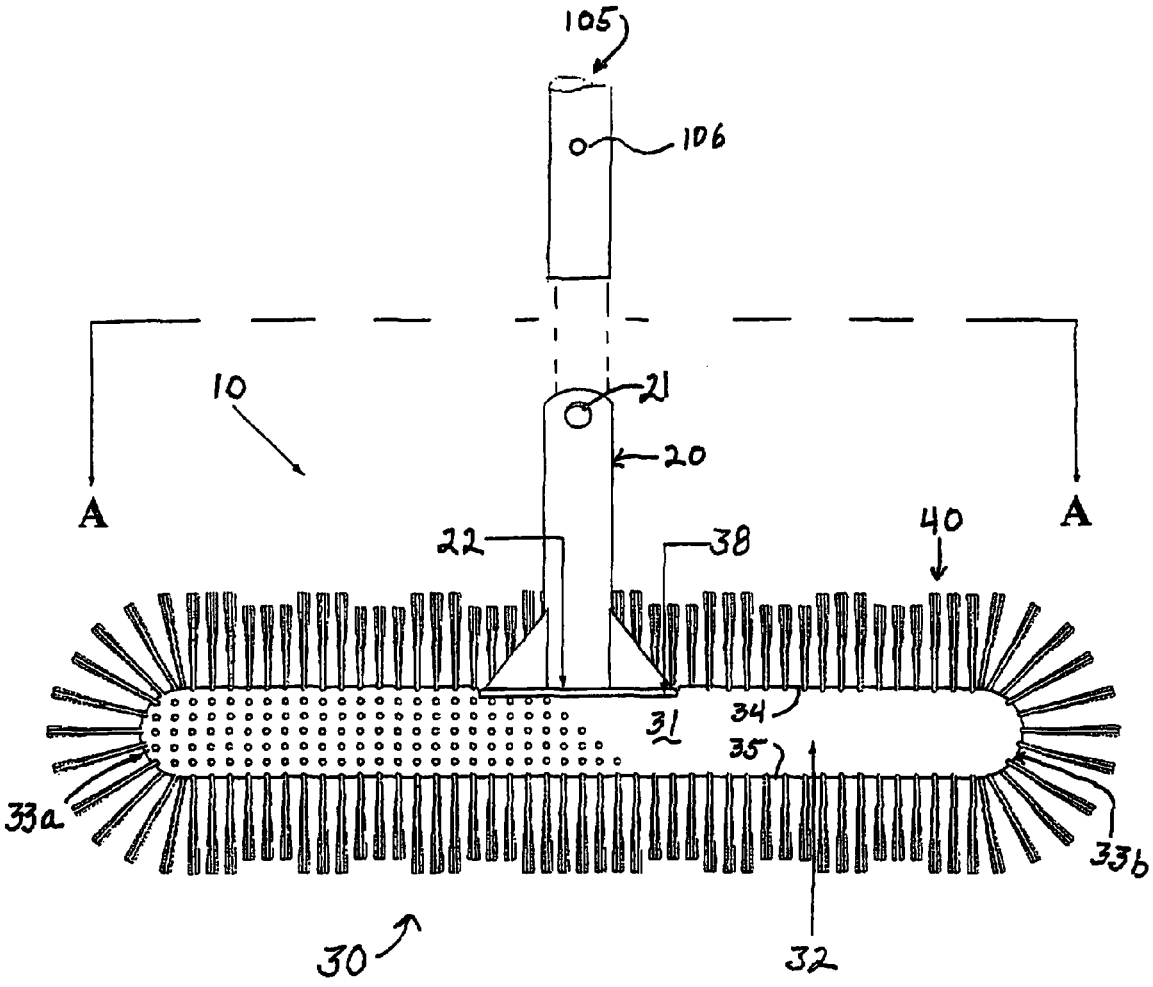
FIG. 1 is a front elevational view of the pool brush of the invention.
Figure 2:
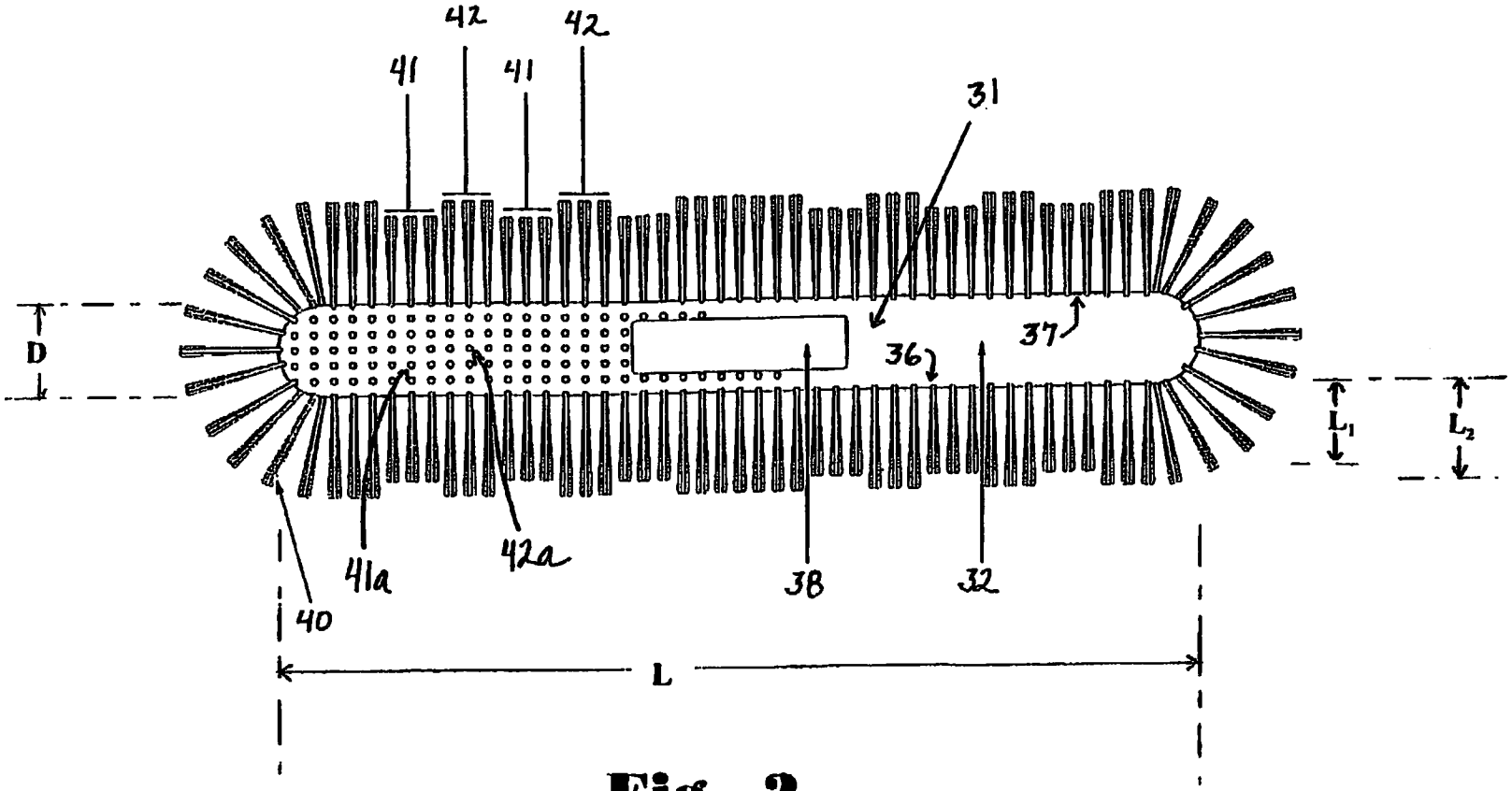
FIG. 2 is a top view of the brush head of FIG. 1 along lines A-A.
Figure 3:
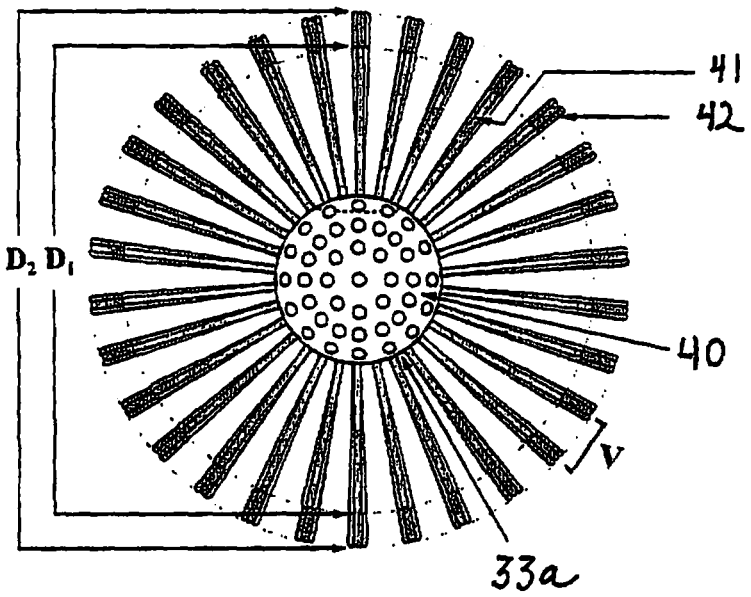
FIG. 3 is an end view of the brush head of FIG. 2.

FIG. 1 is a front elevational view of the brush 10 of the subject invention. FIG. 2 is a top view of the brush head of FIG. 1 taken along line A-A. FIG. 3 is an end view of the brush head of FIG. 2.

Referring to FIGS. 1-3, brush 10 includes a longitudinal handle receiver 20 having a generally rectangular bottom plate 22 which can be removably engaged in a correspondingly shaped recess 38 in the mid-portion of the top 34 of the body 31 of brush head 30 by conventional fasteners. Handle receiver 20 preferably comprises a metal or plastic tubular member having an axial channel to receive an elongated handle 105. Handle 105 can be fabricated from metal (e.g., aluminum, stainless steel, etc.) or plastic (polyvinyl chloride, polycarbonate, etc.). In an embodiment handle 105 includes a resilient button 106 configured to snap into opening 21 in the tubular member of handle receiver 20 when the handle is removably engaged therewith. Alternatively, opening 21 in the side of the tubular member is configured to receive a screw or other fastener to secure the engagement of the handle 105 with the handle receiver 20.

Body 31 has a middle cylindrical portion 32, having a rounded top side 34, bottom side 35 and front and rear sides 36 and 37, respectively. Body 32 further has opposite end portions 33*a* and 33*b*. Recess 38 in the top 34 of the body 31 preferably has a depth equal to the thickness of plate 22 such that the top surface of plate 22 is flush with the exterior surface of the body 31. Body 31 can have any length and diameter suitable for the purposes described herein. In an embodiment, body 31 can have a length L ranging from 6 inches to 30 inches, preferably 10 to 18 inches. Typically, body 31 can have a diameter D ranging from approximately 1 to 3 inches. Opposite ends 33*a* and 33*b* can be flat or hemispherical, conical, or otherwise rounded portions. Body 31 can be formed from injection molded plastic, metal such as aluminum or stainless steel, and the like.

Extending radially from the central cylindrical portion 32 of the body 31, bristles 40 can comprise alternating arrays of bundles of short bristles 41 and bundles of long bristles 42, said arrays extending circumferentially around the cylindrical portion 32 and each array 41 and 42 including at least one, and preferably 2 to 4 circumferential rows 41*a* and 42*a*, respectively, of bristles. The short bristles 41 can extend for a length $L_1$ of from about ½ to about 3½ inches. The long bristles 42 can extend for a length $L_2$ of from about ¾ to about 3¾ inches, wherein $L_2$ is greater than $L_1$ such that the ratio $L_2/L_1$ ranges from about 1.05 to about 1.5 and more preferably from about 1.1 to 1.3. It should be understood that the dimensions and ratios given above are for illustrative purposes only. Dimensions, quantities and ratios outside of the given ranges can be employed whenever appropriate.

The outer diameter of the arrays of the short bristles 41 is depicted in FIG. 3 as $D_1$ wherein $D_1=2L_1+D$. The outer diameter of the arrays of the long bristles 42 is depicted in FIG. 3 as $D_2$ wherein $D_2=2L_2+D$.

Across all adjacent rounded surfaces, the bundles of bristles in an array can be in an angular orientation with respect to each other. In particular the bundles of bristles can be oriented at an angle V (FIG. 3) with respect to adjacent bundles, wherein angle V can be any angle suitable for the purposes described herein. In an embodiment, V can range from about 1 to 30 degrees, preferably 5 to 20 degrees and more preferably 5 to 15 degrees. Bristles 40 also extend radially outward from the end portions 33*a* and 33*b* and can be long bristles or short bristles.

Moreover, bristles 40 can have different densities so as to be alternatingly hard and soft bristles. For example, the bundles of long bristles 42 can comprise relatively soft bristles and the bundles of short bristles 41 can be relatively harder (or stiffer) bristles, or vice versa. The difference in hardness of the bundles can be achieved by increasing the number of bristles in a bundle. Alternatively, the difference in hardness can be achieved by using different materials to fabricate the bristles of the different bundles. For example, the softer bristles can be fabricated from nylon while the stiffer bristles can be fabricated from polypropylene or polybutylene terephthalate.

Figure 4:
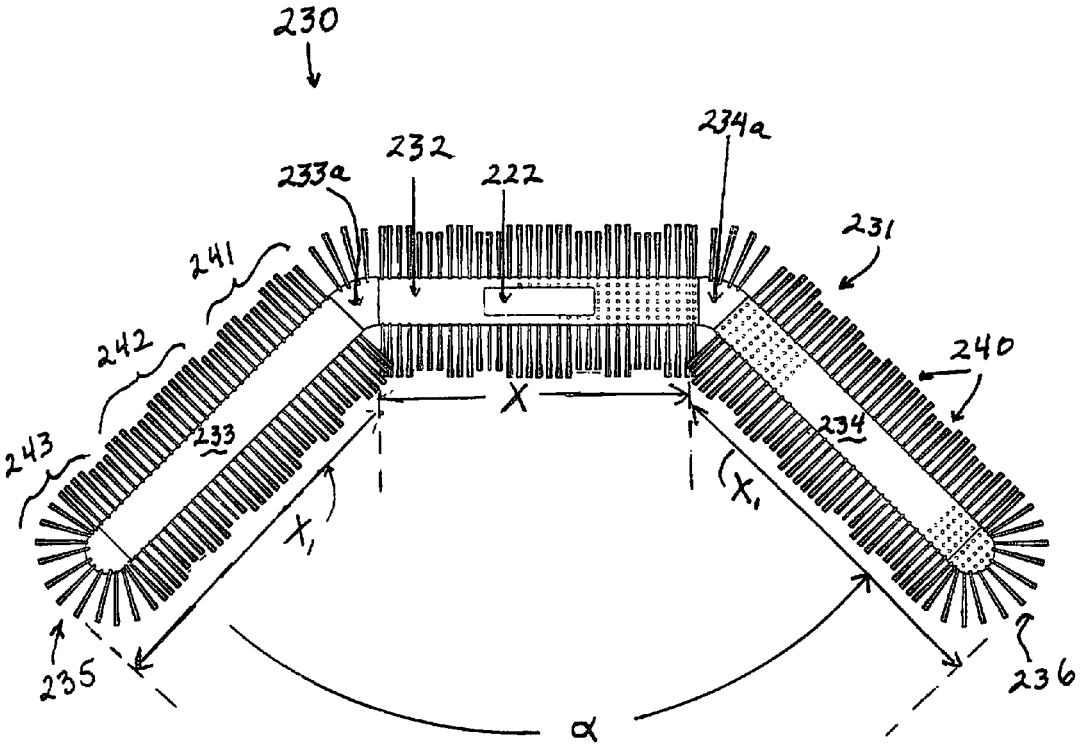
FIG. 4 is a top view of another embodiment of the pool brush of the invention.

Referring now to FIG. 4, In another embodiment brush head 230 includes a generally cylindrical body 231 and bristles 240 extending radically outward from the body 231. Recess 222 on the top of the cylindrical body 231 is configured and dimensioned to receive a corresponding bottom plate of a handle receiver. Body 231 includes a middle portion 232 and at least one, and preferably two angled arm portions 233 and 234 extending therefrom. The middle portion 232 and angled arm portions 233 and 234 can be formed integrally so that body 231 is a single piece member or, angled arm portions 233 and 234 can be hingedly connected to middle portion 232 at bends 233*a* and 234*a* so as to be separately adjustable. Arm portion 233 is rectilinear and extends from bend 233*a*, at which it is connected to middle portion 232, to end 235. Arm portion 234 is rectilinear and extends from bend 234*a*, at which it is connected to an opposite end of middle portion 232, to end 236. Ends 235 and 236 are illustrated as hemispherical, but alternatively can be flat, conical or otherwise shaped. In an embodiment, arm portions 233 and 234 together define an angle $\alpha$ which can range from about 10 degrees to about 170 degrees so as to substantially provide a V-shaped or U-shaped structure. Preferably, a ranges from about 70 degrees to about 110 degrees and more preferably about 80 degrees to about 100 degrees. Bends 233*a* and 234*a* preferably are each ½ $\alpha$. Alternatively, bends 233*a* and 234*a* can be adjustably positioned at different angles.

The middle portion 232 has a length X and the arms 233 and 234 each have a length $X_1$. The ratio of $X_1/X$ preferably ranges from 1.0 to about 2.0 and more preferably from 1.1 to about 1.8.

Bristles 240 are preferably arranged in an array of bundles which radially extend outwardly from around the 360 degree outer surface of the body 231. The bristles can be arranged in long and short bundles as discussed above with respect to the pool brush as shown in FIGS. 1 to 3. Alternatively the bristles 240 can be of equal length. In an embodiment the bristles 240 on each arm can include a proximal portion 241 next to the bend (233*a*, 234*a*), an intermediate portion 242, and a distal portion 243 at the end (235, 236). The bristle portions 241, 242 and 243 can include different types of bristles. For example, the bristles of portions 241, 242 and 243 can differ in thickness, material of fabrication, number of bristles per bundle, color, density and/or softness or stiffness. Also, one or more of the bristle portions 241, 242 and 243 can be fabricated from softer nylon bristles and one or more of the bristle portions 241, 242 and 243 can be fabricated from stiffer polypropylene bristles or polybutylene terephthalate.

Figure 5:
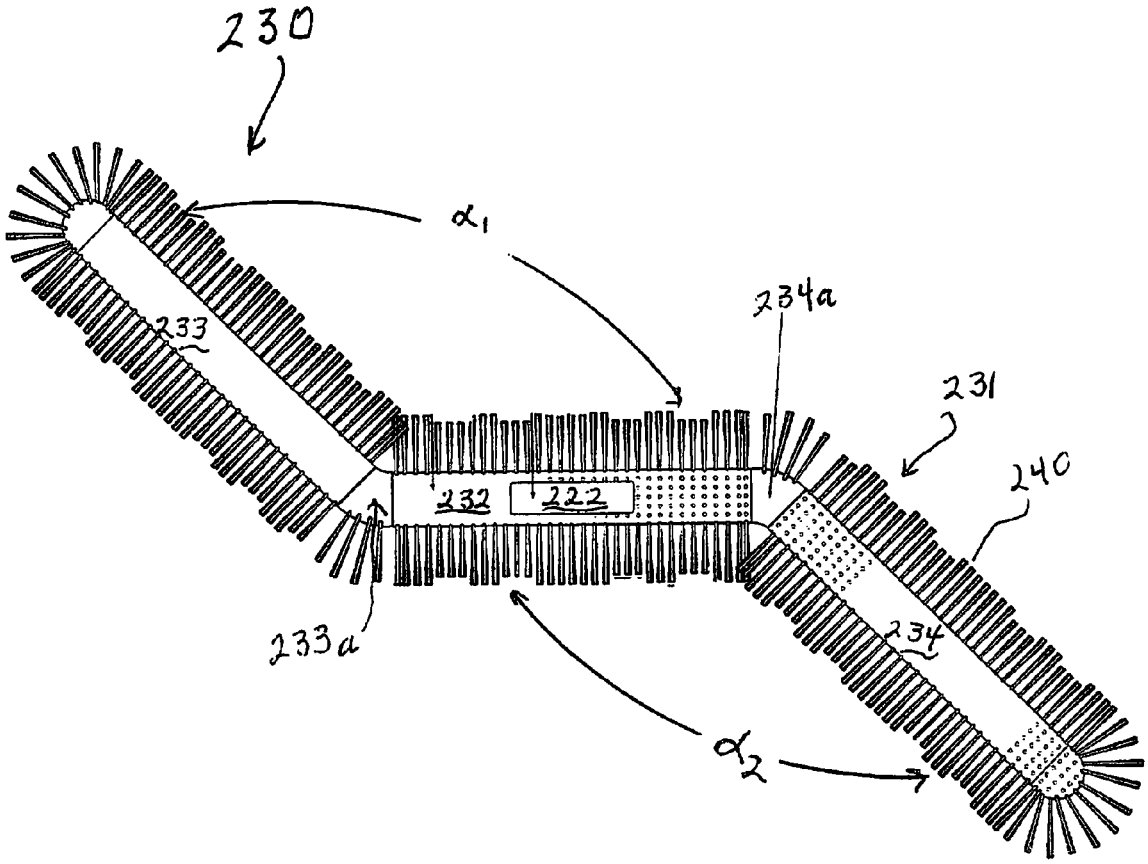
FIG. 5 is a top view of another embodiment.

In another embodiment, as shown in FIG. 5, the arm portions 233 and 234 can be bent in different directions. For example, one arm portion can be bent forward to the front and the other arm portion can be bent backward toward the rear of the swimming pool brush. The bends 233*a*, 234*a* can be hinged connections, or flexed connections. Alternatively, the bends 223*a* and 234*a* can comprise angled members to which the arm portions 233 and 234 are rotatably connected so that they can be swiveled to the front or back. In an embodiment one arm (e.g., arm 233) can be bent at an angle $\alpha_1$ and the other arm (e.g., 234) can be bent at angle $\alpha_2$, wherein $\alpha_1$ and $\alpha_2$ can be the same or different and preferably individually adjustable.

The pool brush of the invention provides 360 degree cleaning and can clean around, the tops and undersides of steps, the surfaces of walls and floors, corners, or virtually anywhere in or around a swimming pool or spa.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A pool brush which comprises:

a) a brush head having a body and a plurality of bristles extending from said body, wherein said body includes a cylindrical portion having rounded top, bottom, front and rear sides, and opposite end portions, and said plurality of bristles includes bristles radially extending 360 degrees around a major portion of the cylindrical portion of the body as viewed in an end view.

2. The pool brush of claim 1 further comprising a handle receiver attached to the top side of the cylindrical portion of the body, the handle receiver comprising a tubular member and a bottom plate attached to the tubular member, wherein cylindrical portion of the body has a recess configured and dimensioned to as to receive the bottom plate of the handle receiver.

3. The pool brush of claim 2 further comprising an elongated handle removably received in an axial bore of the tubular member of the handle receiver.

4. The pool brush of claim 3 wherein the handle includes a resilient member configured to releasably engage an opening in the tubular member.

5. The pool brush of claim 1 wherein the opposite end portions each have perpendicularly extending bristles.

6. The pool brush of claim 5 wherein the end portions are hemispherical or flat.

7. The pool brush of claim 1 wherein the plurality of bristles includes relatively longer bristles and relatively shorter bristles in an array of bundles.

8. The pool brush of claim 7 wherein the shorter bristles have a length $L_1$ and the longer bristles have a length $L_2$, and wherein a ratio $L_2/L_1$ ranges from about 1.05 to about 1.5.

9. The pool brush of claim 8 wherein the ratio $L_2/L_1$ ranges from about 1.1 to about 1.3.

10. The pool brush of claim 1 wherein the plurality of bristles includes relatively stiffer bristles and relatively softer bristles.

11. The pool brush of claim 1 wherein the bristles are fabricated from nylon, polypropylene or polybutylene terephthalate.

12. The pool brush of claim 1 wherein the body has a length ranging from 6 inches to 30 inches.

13. The pool brush of claim 1 wherein the body has a diameter ranging from approximately 1 to 3 inches.

14. The pool brush of claim 1 wherein the body comprises a central portion and two arm portions attached to the central portion at respective bend points.

15. A pool brush which comprises:

a) a brush head having a body and a plurality of bristles extending from said body, wherein said body includes a cylindrical portion having rounded top, bottom, front and rear sides, and said plurality of bristles includes bristles radially extending 360 degrees around a major portion of the cylindrical portion of the body, wherein the body comprises a central portion and two arm portions attached to the central portion at respective bend points, wherein the arm portions are individually adjustable to positions at an angle from the central portion.

16. The pool brush of claim 15 wherein the two arm portions are movable so as to be oriented in a substantially V-shaped configuration defined by an angle $\alpha$ of from about 10 degrees to about 170 degrees.

17. The pool brush of claim 16 wherein the angle $\alpha$ is from about 70 degrees to about 110 degrees.

18. The pool brush of claim 14 wherein each arm portion has a length $X_1$ and the central portion has a length X such that the ratio of $X_1/X$ ranges from 1 to 2.

19. The pool brush of claim 15 wherein the arm portions are individually movable so as to be oriented in a Z-shaped configuration respectively defined by angles $\alpha_1$ and $\alpha_2$, wherein angles $\alpha_1$ and $\alpha_2$ can be the same or different and can range from 90 degrees to 170 degrees.

20. The pool brush of claim 14 wherein the bristles are arranged in an array of bundles, each bundle including a plurality of bristles and said array on each arm portion including a proximal portion, an intermediate portion and a hemispherical distal portion, wherein the bristles of one or more of said portions of the array of bristles differ from the bristles in the other portion(s) in one or more features of thickness, material of fabrication, number of bristles per bundle, color, density, stiffness or softness.

21. The pool brush of claim 1 wherein the end portions are hemispherical or flat.

22. The pool brush of claim 1 wherein the end portions are hemispherical.

23. The pool brush of claim 5 wherein the end portions are hemispherical.

* * * * *